US007342163B2

(12) United States Patent
O'Donnell

(10) Patent No.: US 7,342,163 B2
(45) Date of Patent: Mar. 11, 2008

(54) APPARATUS AND METHOD FOR OFFSETTING AND TILTING HI-HAT CYMBALS

(76) Inventor: Richard L. O'Donnell, 142 Willow Brook, St. Louis, MO (US) 63146

( * ) Notice: Subject to any disclaimer, the term of this patent is extended or adjusted under 35 U.S.C. 154(b) by 259 days.

(21) Appl. No.: 11/119,974

(22) Filed: May 2, 2005

(65) Prior Publication Data

US 2006/0243117 A1 Nov. 2, 2006

(51) Int. Cl.
*G10D 13/02* (2006.01)

(52) U.S. Cl. ..... 84/422.3

(58) Field of Classification Search ..... 84/411 R, 84/422.1, 422.3, 421, 422.2; D17/22
See application file for complete search history.

(56) References Cited

U.S. PATENT DOCUMENTS

| | | | | |
|---|---|---|---|---|
| 3,167,995 | A | 2/1965 | La Londe | |
| 3,464,305 | A * | 9/1969 | Meazzi et al. | 84/422.3 |
| 3,742,810 | A * | 7/1973 | Crigger | 84/422.3 |
| 4,381,690 | A | 5/1983 | Kimble | |
| 4,449,440 | A | 5/1984 | Hoshino | |
| 4,458,574 | A | 7/1984 | Hoshino | |
| 4,497,238 | A | 2/1985 | Dasovich | |
| 4,517,876 | A | 5/1985 | Duhon | |
| 4,528,888 | A | 7/1985 | Hoshino | |
| 4,667,562 | A * | 5/1987 | Lee | 84/422.3 |
| 4,846,040 | A | 7/1989 | Hoshino | |
| 5,018,426 | A | 5/1991 | Suzuki | |
| 5,052,262 | A | 10/1991 | Havens | |
| 5,063,819 | A | 11/1991 | Hoshino | |
| 5,218,151 | A | 6/1993 | Kurosaki | |
| 5,266,733 | A | 11/1993 | Jacobson | |
| 5,388,495 | A | 2/1995 | Atsumi | |
| 5,808,217 | A | 9/1998 | Liao | |
| 5,836,561 | A | 11/1998 | Liao | |
| 5,936,176 | A | 8/1999 | Lombardi | |
| 6,003,822 | A | 12/1999 | Kurosaki | |
| 6,011,209 | A | 1/2000 | Liao | |
| 6,054,645 | A | 4/2000 | Gauger | |
| 6,177,621 | B1 | 1/2001 | Hoshino | |
| 6,259,011 | B1 | 7/2001 | Liao | |
| 6,268,556 | B1 | 7/2001 | Liao | |
| 6,307,137 | B1 | 10/2001 | Liao | |
| 6,316,708 | B1 | 11/2001 | Kuppers | |
| 6,329,584 | B1 | 12/2001 | Liao | |
| 6,399,865 | B1 | 6/2002 | Ishimatsu | |
| 6,528,714 | B1 | 3/2003 | Liao | |
| 7,094,959 | B2 * | 8/2006 | Marnell | 84/422.3 |

* cited by examiner

*Primary Examiner*—Edwin A. Leon
(74) *Attorney, Agent, or Firm*—Douglas E. Warren

(57) ABSTRACT

The invention is an adjustable cymbal device that is mountable onto a standard hi-hat cymbal. The adjustable cymbal device operatively connects a primary actuator rod connected to the foot pedal on the standard hi-hat cymbal stand to a secondary actuator rod upon which a set of cymbals has been mounted. To allow for adjustment of the adjustable cymbal device in relation to the standard hi-hat stand and to the desired playing position of a percussionist, the adjustable cymbal device provides the ability to adjust the length of travel of the upper cymbal, the tilt and offset of the adjustable cymbal device, the rotational angle of the adjustable cymbal device, and the tilt between the lower cymbal relative to the upper cymbal.

33 Claims, 7 Drawing Sheets

APPARATUS AND METHOD FOR OFFSETTING AND TILTING HI-HAT CYMBALS

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

Typically, hi-hat percussion instruments include a pairing of two cymbals that come together to make a clashing cymbal sound by action of a foot pedal. Most often, the upper cymbal is connected to the foot pedal by an actuator rod passing through the stand with a biasing element in the stand adjacent to the pedal to bias the upper cymbal up and away from the fixed lower cymbal. In previous inventions, the center of the cymbal is directly in line with the center of the stand and is not significantly adjustable. Therefore, previous designs do not allow performers to position the cymbals relative to the performer in a proper ergonomic arrangement to achieve the proper response from the hi-hat.

The hi-hat can be played by striking it with a drumstick or brush with the cymbals brought together ("closed"), or apart ("open"), or by using the pedal to forcefully bring the cymbals together. When struck closed or played with the pedal, the hi-hat gives a short, dry percussive sound. Adjusting the gap between the cymbals can alter the length of travel required by the foot to close the cymbals.

Previous designs of hi-hat devices provide a means of opening and closing the cymbals with a flexible member connecting the cymbals to the foot pedal. Unfortunately, the flexible members result in sloppier and slower response of the closing motion between the cymbals. In fact, there are no presently known commercially available hi-hat devices that offer any offset or tilting capabilities that do not depend upon the sloppier action of cable mechanisms. In addition, while some standard hi-hat stands that are now commercially available offer the ability to tilt the upper cymbal in relation to the lower cymbal, there are no hi-hat devices that allow for the tilt of both the upper and lower cymbal together.

Therefore, what is needed is a hi-hat device with greater adjustability to allow performers to position the cymbals to achieve a the proper ergonomic relationship relative to the performer. In addition, a hi-hat device with a rigid mechanical connection between the foot pedal and cymbals is needed to achieve a quick and smooth response.

SUMMARY OF THE INVENTION

The present invention offers a unique device for positioning hi hat cymbals. More specifically, the present device provides tilting capabilities, offset capabilities, and the capability of rotating the cymbals around the primary vertical axis of a standard hi-hat stand.

A brief analysis of the playing position of a percussionist using a normal hi-hat device will highlight the benefit of the present invention. For example, a percussionist is in the normal position for playing a hi-hat when the percussionist sits upright in a hard chair, with the percussionist's left leg below the knees hanging straight downward. As the percussionist plays the hi-hat, all of the motion used to operate the hi-hat should come from the ankle—not the hip of the percussionist. It is noted that it is the weight of the percussionist's leg that provides the force to close the hi-hat cymbals with a sharp "chik" sound. In positioning the left arm of the percussionist to play the hi-hat, the left arm of the percussionist should be initially positioned with the left arm hanging straight down, and relaxed. Then, the elbow should be bent about 90 degrees and the left hand of the percussionist should rest slightly above the percussionist's kneecap. The percussionist is now in an optimum starting position for playing the hi-hat cymbals.

From this starting position, if the percussionist holds a drumstick in the left hand, the reach of the percussionist would be extended about 10-12 inches beyond the foremost part of the percussionist's left hand. The left foot extends about 7-8 inches beyond the front of the percussionist's leg, and the primary upright tube of the hi-hat device extends vertically from the position just above the tip of the percussionist's toe. In this position, if the left arm of the percussionist is to hang in a relaxed, vertical position, the playing spot on the hi-hat cymbals, must be moved away from the percussionist's left hand—not toward the percussionist's left hand as required by other presently available hi-hat tilting devices. Other previous devices used in the past work incorrectly by causing the cymbals to move toward the percussionist when the tilt angle of the cymbals is adjusted, and thus fails to allow a percussionist to tilt the cymbals while still maintaining the best overall orientation of the percussionist's playing position and the hi-hat being played.

In contrast to the above described previous devices, the present invention allows the percussionist to tilt the hi-hat device without compromising of the best optimum playing position for the percussionist. Additionally, the design of the present invention provides these benefits to left or right handed percussionists. Also, the unique mechanical design of the present invention offers a significant mechanical operating advantage when compared to other hi-hat devices. The present design offers improved sensitivity and better response due to the 2 to 1 ration in the lever action design of the actuator links in the present invention. This increased mechanical advantage offers the percussionist a greater degree of playing flexibility, while also decreasing the effort expended by the percussionist during a performance.

DESCRIPTION OF THE DRAWINGS

In the accompanying drawings which form part of the specification.

Corresponding reference numerals indicate corresponding parts throughout the several figures of the drawings.

While one embodiment of the present invention is illustrated in the above referenced drawings and in the following description, it is understood that the embodiment shown is merely one example of a single preferred embodiment offered for the purpose of illustration only and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF ONE EMBODIMENT OF THE INVENTION

Figure 1:
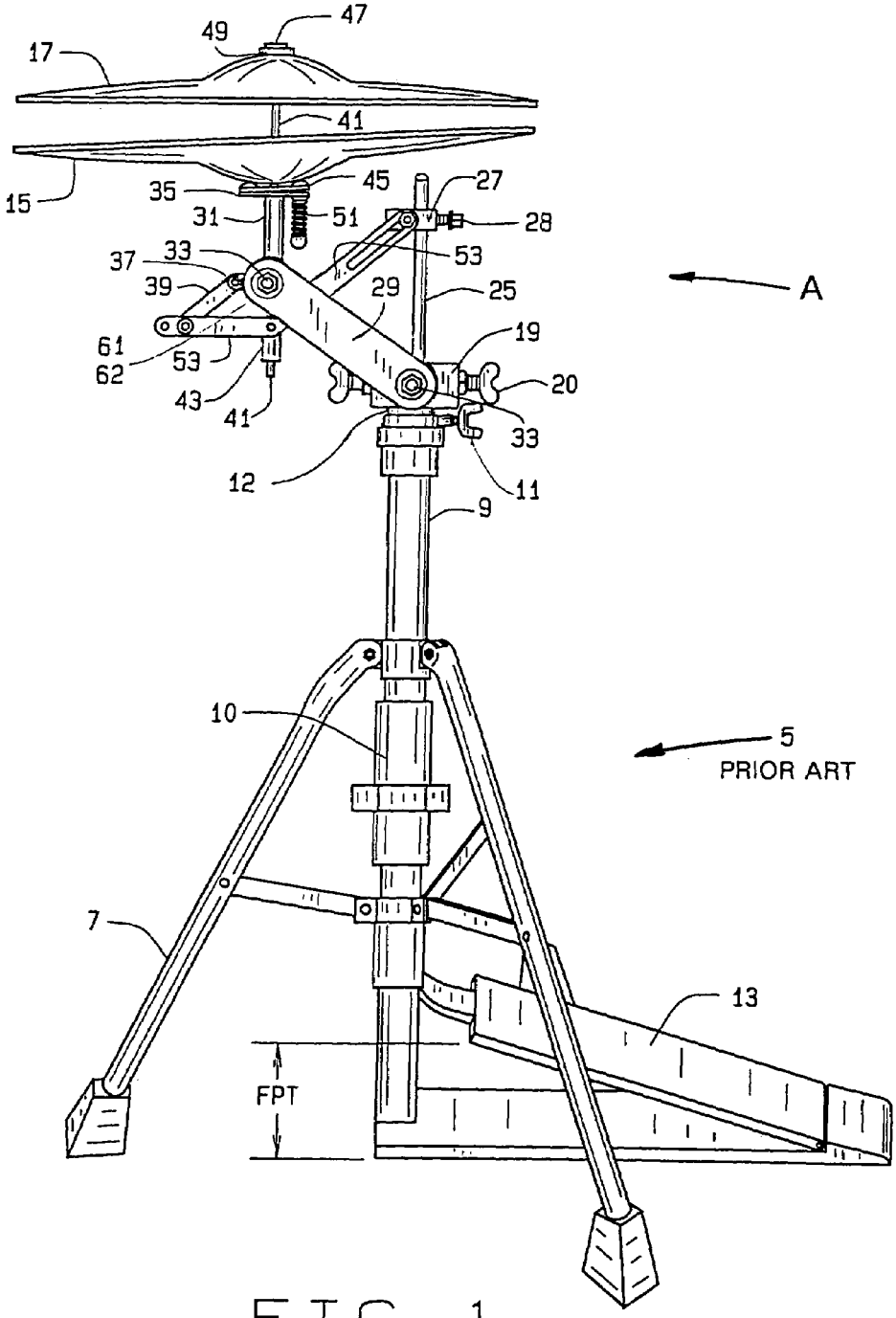
FIG. 1 is a side elevation view of one embodiment of the present invention as it would be mounted on a standard hi-hat cymbal stand.
Figure 6:
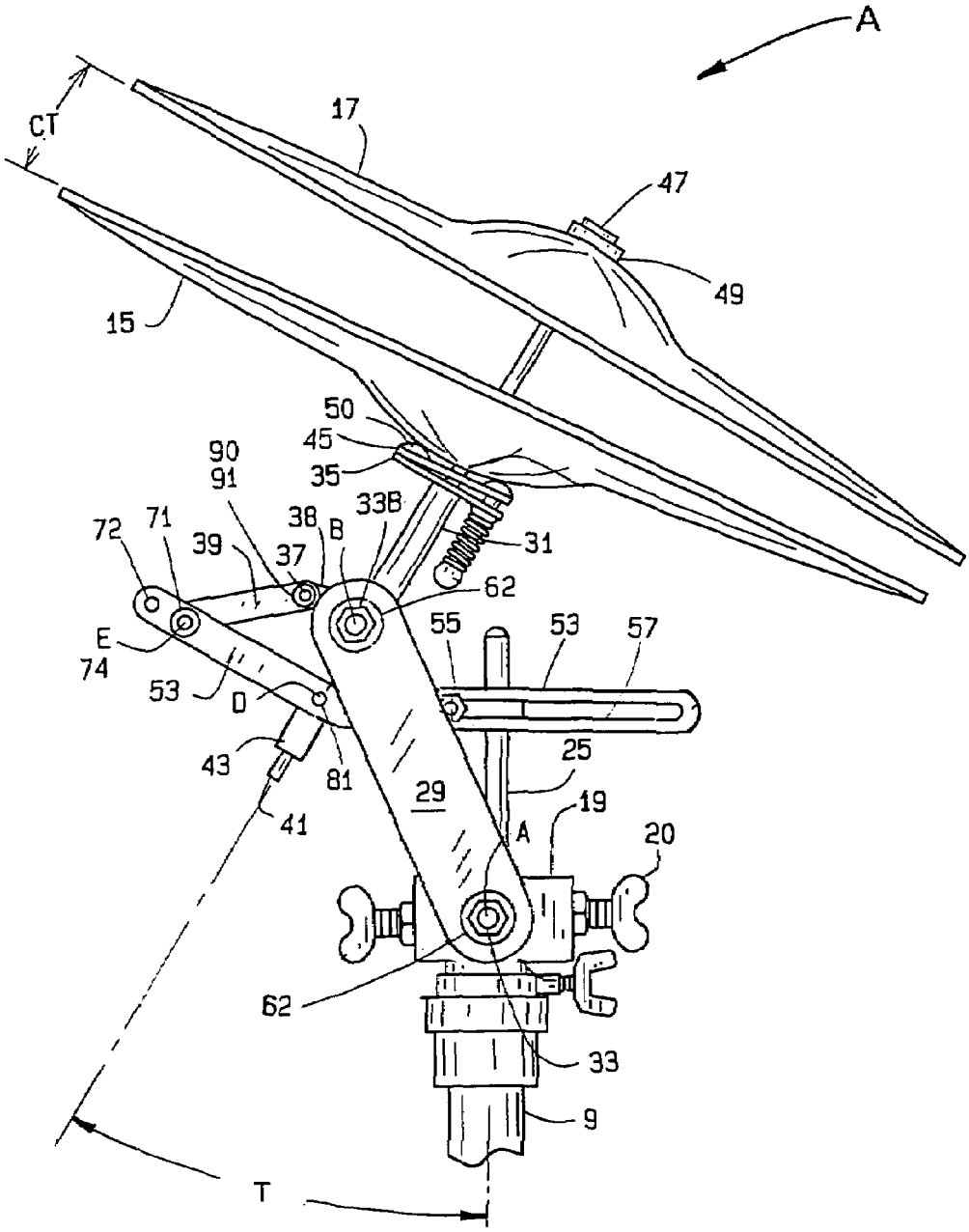
FIG. 6 is a partial side elevation view of one embodiment of the present invention illustrating the hi-hat cymbals in a tilted position to show the adjustable tilting and offsetting positions of the device for one embodiment of the present invention.

Referring now to FIG. 1 and FIG. 6, a preferred embodiment of the present invention of an adjustable cymbal device A is shown. In this particular embodiment, a hi-hat percussion instrument is assembled by mounting one embodiment of the adjustable cymbal device A to a generally standard cymbal stand 5. The standard cymbal stand 5 is not part of the present invention and is of a type commonly known in the art. The standard cymbal stand 5 includes legs 7 that are mounted to a hollow primary support shaft 9. A height adjustment clamp 11 is located at the upper end of the hollow primary support shaft 9 for securing an extendable tube 12. The standard cymbal stand 5 also includes a foot pedal 13 at a lower end operatively connected to the preferred embodiment of the adjustable cymbal device A.

Figure 4:
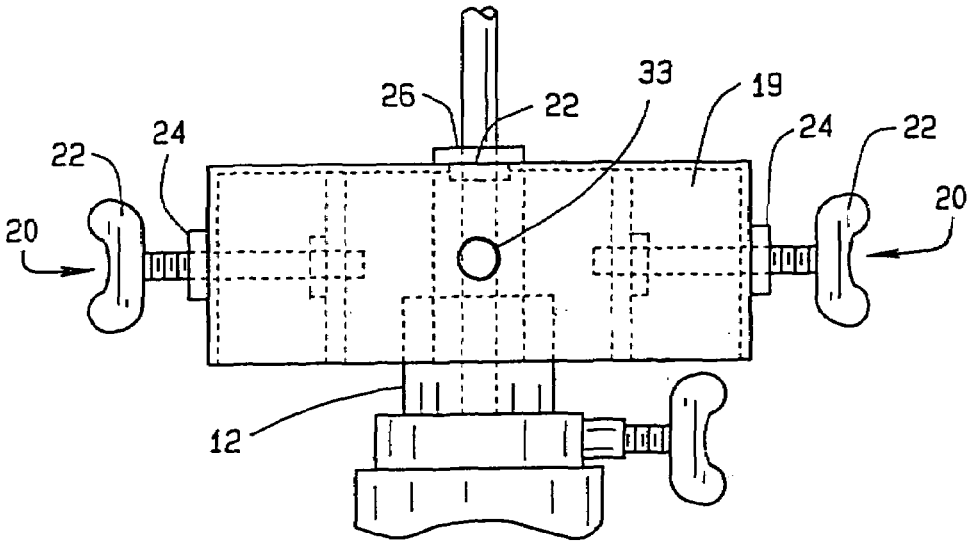
FIG. 4 is a partial side view showing the rectangular mounting block for one embodiment of the present invention.
Figure 5:
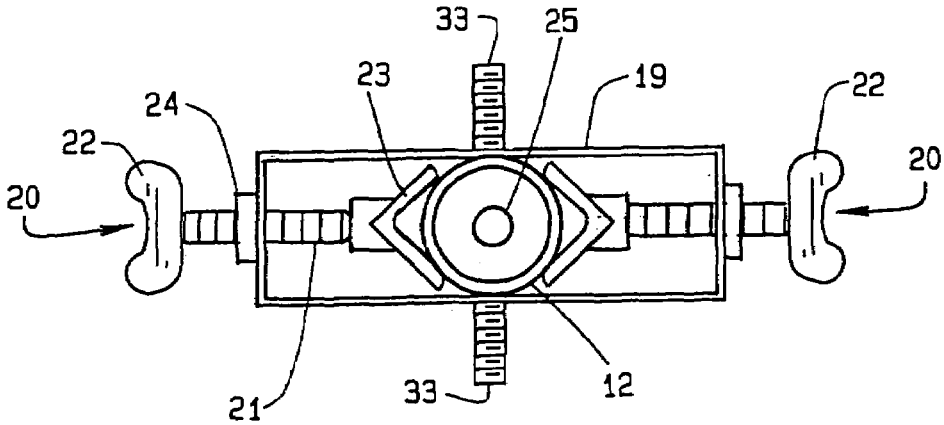
FIG. 5 is an underside view of the rectangular mounting block for one embodiment of the present invention.

The adjustable cymbal device A is mounted onto the standard cymbal stand 5 using a rectangular mounting block 19 and fasteners 20. As shown in FIG. 4 and FIG. 5, the rectangular mounting block 19 is substantially in the form of a rectangular box having a rectangular opening on its bottom that receives the extendable tube 12. The extendable tube 12 is secured within the opening in the bottom of the rectangular mounting block 19 by two fasteners 20. In the present embodiment, each of the fasteners 20 has a threaded rod 21 with a wing nut 22 attached to an external end and a V-shaped clamp 23 pivotally attached to an internal end. It is appreciated that other types of fasteners may be used as long as the fastener selected is capable of moving the V-shaped clamps 23 to capture the extendable tube 12. The V-shaped clamp 23 allows the fasteners 20 to engage various sizes of extendable tubes 12 so that the rectangular mounting block 19 of the adjustable cymbal device A is almost universally adaptable and can attach to almost any standard cymbal stand 5.

The rods 21 engage with threaded bores 24 located on each end of the rectangular mounting block 19, so that the fasteners 20 are rotated to advance the fasteners inwardly until the two V-shaped clamp 23 contacts the extendable tube 12 to secure the extendable tube between the two V-shaped clamps. The fasteners 20 are rotated in an opposite direction to move the V-shaped clamps away from the extendable tube 12 to release the rectangular mounting block 19 from the extendable tube. It is appreciated that the rectangular mounting block 19 and fasteners 20 of the present embodiment are shaped and sized to accommodate the most common shape and size extendable tubes 12 commonly found on a standard cymbal stand 5. However, it is understood that the rectangular mounting block 19 and fasteners 20 can be made from other shapes and sizes to accommodate any shape and size cymbal stand while still remaining within the scope of the present invention.

A biasing element 10 (FIG. 1) is connected to the primary actuator rod 25 and the foot pedal 13. The primary actuator rod 25 is operatively connected to the foot pedal 13, and the biasing element 10 acts to bias the toe end of the foot pedal 13 and the primary actuator rod 25 upward. Such biasing elements are well known to those skilled in the art and almost any type of biasing element may be used in the standard cymbal stand 5 and still allow the current embodiment of the present invention to function properly.

Figure 2:
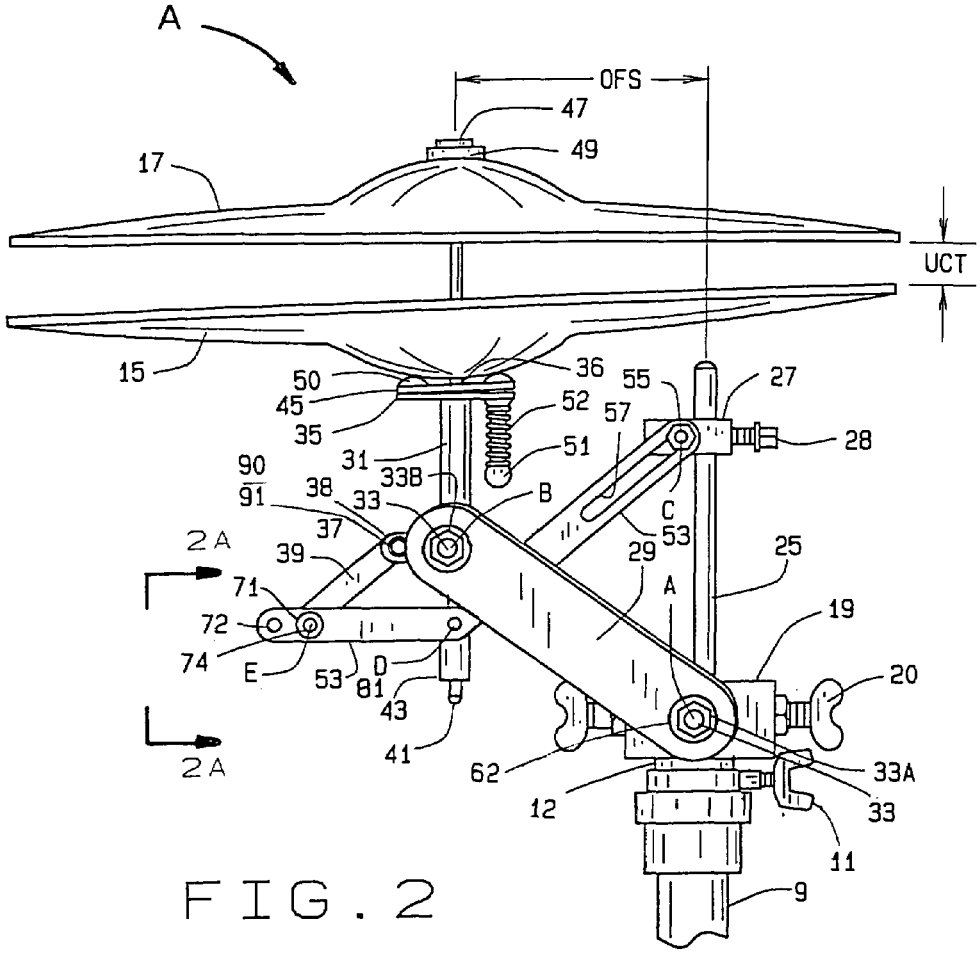
FIG. 2 is a partial side elevation view showing one embodiment of the present invention in greater detail.

Referring now to FIG. 1, FIG. 2, and FIG. 4, the foot pedal 13 of the standard cymbal stand 5 is connected to a primary actuator rod 25 that passes upwardly through the hollow support shaft 9, the extendable tube 12, and a bushing 26 installed into the rectangular mounting block 19. After passing through the bushing 26, the upper end of the primary actuator rod 25 passes through the primary clamp 27 and adjustably secured within the primary clamp 27 with a fastener 28. It is appreciated that other types of appropriate fasteners such as bolts and thumbscrews may also be used. In the preferred embodiment, the opening in the bushing 26 through which the primary actuator rod 25 is passed is between about 0.28 inch and about 0.29 inch in diameter. It will be appreciated, however, that the opening in the bushing 26 may be sized as needed to fit the primary actuator rod 25 of any cymbal stand 5 and still remain within the scope of the present invention.

It is noted that the remainder of the components of the adjustable cymbal device A are substantially suspended from the primary clamp 27 and the rectangular mounting block 19. More specifically, FIG. 2 and FIG. 6 show two tilting links 29 that are attached to the rectangular mounting block 19. One end of each of the two tilting links 29 is connected to one of the threaded rods 33 of the rectangular mounting block 19 at an axis A by a nut 33A and a washer 62. The nut 33A captures one end of each of the two tilting links 29 between the outer surface of the rectangular mounting block 19 and the washer 62. Each of the other ends of the two tilting links 29 is attached to two flanges 38 of a secondary rod guide assembly 31 at axis B by means of threaded rods 63 (FIG. 9) that extend from the two flanges 38 of the secondary rod guide assembly 31, and by a nut 33B (FIG. 2 and FIG. 6) that captures the end of each of the two tilting links 29 between one flange 38 and one washer 62.

Figure 9:
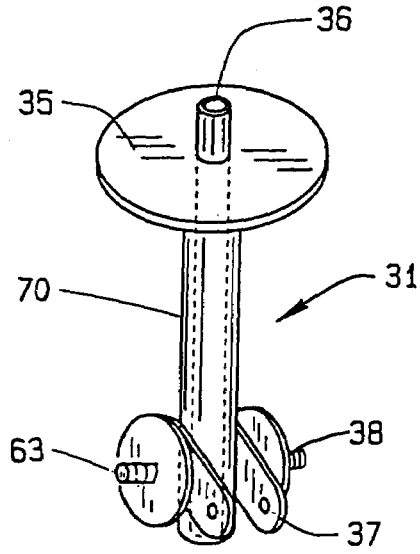
FIG. 9 is a perspective view of the secondary shaft arrangement for one embodiment of the present invention.

Referring now to FIG. 9, the secondary rod guide assembly 31 comprises a vertical tube 70, two circular flanges 38, two tabs 37, two friction washers (not shown), a bushing 36, an upper flange 35, and two threaded rods 63. The two tabs 37 are attached to the vertical tube 70 near one end of the vertical tube and at about a 90 degree angle with the vertical tube such that the two tabs are generally parallel with each other. The two circular flanges 38 are positioned in general alignment with the two tabs 37 such that the flat surfaces of the two circular flanges 38 are generally parallel with the flat surfaces of the two tabs 37. Each tab 37 has a friction washer positioned between each circular flange 38 and its related tab 37. While the friction washer may be made of any material, in the present embodiment, the friction washer is made of rubber. A threaded rod 63 protrudes from the center of each of the two circular flanges 38. It is understood that the two threaded rods 63 are in axial alignment. The bushing 36 is sized to allow the bushing to be inserted into the vertical tube 70 while still allowing the secondary rod 41 (FIG. 2) to easily slide within the bushing. In the present embodiment, the bushing 36 (FIG. 9) is made from nylon and has an inside diameter of about 0.28 inch and an outside diameter of about 0.38 inch.

As shown in FIG. 2, an adjustment screw 51 is threaded through the flange 35 to engage the adjustment washer 45. A nut 80 is attached to the underside of the upper flange 35 to receive the adjustment screw 51 and allow for the threaded adjustment of the adjustment screw. A compression spring 52 is used in combination with the adjustment screw 51 to prevent the adjustment screw 51 from backing out as a result of the vibration of the cymbals 15 and 17 when they are struck by the percussionist.

As shown in FIG. 2 and FIG. 6, two actuator links 53 are slideably attached to a nut and bolt 55 on the primary clamp 27 at axis C. The two actuator links 53 are also attached to a secondary clamp 43 at an axis D, and to an extension link 39 at axis E. The actuator links 53 in the present embodiment are obtusely angled plates rigidly fixed at a predetermined obtuse angle. An opening 81 is located near the apex of the obtuse angle of each actuator link 53. One end of each of the two actuator links 53 has a slot 57 that allows each actuator link to reciprocate around the bolt and nut 55. The other end of each of the two actuator links 53 has two openings 72 and 74 aligned long the longitudinal axis of the actuator link and spaced a distance apart. One end of the extension link 39 (FIG. 2A) is attached to the two actuator links 53 with a pin 73 and two snap rings 71. The other end of the extension link 39 (FIG. 2 and FIG. 6) is attached to the two tabs 37 of the secondary rod guide assembly 31 with a pin 90 and two snap rings 91.

The actuator links 53 transmit the movement of the primary actuator rod 25 to a secondary actuator rod 41. This transfer of motion moves the upper cymbal 17 toward or away from the lower cymbal 15 from an open position to a closed position to cause the cymbals to create musical sounds. More specifically, the actuator links 53 connect to the bolt and nut 55 by way of slots 57 and the secondary clamp 43 connects at the elbow of the actuator links 53. The use of rigid mechanical connections between the primary actuator rod 25 and the secondary actuator rod 41 provide an accurate and sensitive response between the foot pedal 13 and the cymbals 15 and 17.

Figure 3:
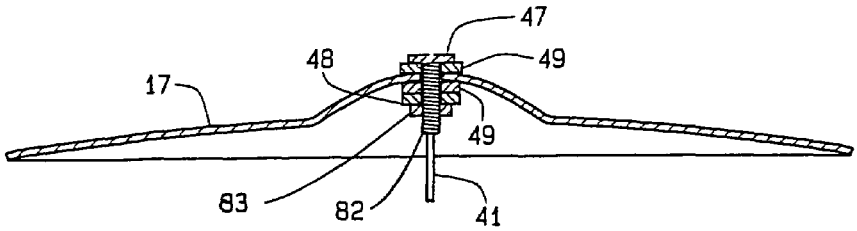
FIG. 3 is a partial sectional view of an upper cymbal attached to a secondary actuator rod in one embodiment of the present invention.

FIG. 2 and FIG. 3 show additional details of the secondary actuator rod 41. The secondary actuator rod 41 has a cap 47 on one end, and includes a threaded portion 82 that extends downwardly from beneath the cap 47. During assembly, the upper cymbal 17 is attached to the secondary actuator rod 41 prior to the installation of the secondary actuator rod into the other components of the adjustable cymbal device A. More specifically, one felt pad 49 is installed between the cap 47 and the upper cymbal 17. It is noted that the felt pad 49 has an opening in its center that allows the threaded portion 82 of the secondary actuator rod 41 to be inserted through the felt pad. The secondary actuator rod 41 is then inserted through the upper cymbal 17 and a second felt pad 49 is positioned on the secondary actuator rod beneath the upper cymbal 17. A first nut 48 is then installed onto the secondary actuator rod 41 by screwing the first nut onto the threaded portion 82 of the secondary actuator rod. A second nut 83 is then installed onto the secondary actuator rod 41 in the same manner. The second nut 83 acts as a jamb nut to ensure that the first nut 48 is not loosened by the vibration of the cymbals 15 and 17 when they are played by a percussionist.

Figure 2A:
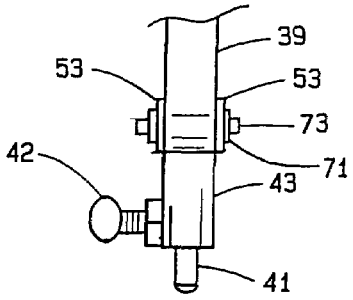
FIG. 2A is a partial side view showing the clamping arrangement for the bottom of the secondary rod in one embodiment of the present invention.

This subassembly of the upper cymbal 17 and the secondary actuator rod 41 is then inserted through the lower cymbal 15, the adjustment washer 45, the bushing 36 of the secondary rod guide assembly 31, and through the secondary clamp 43. The secondary actuator rod 41 is adjustably secured within the secondary clamp 43 by the thumbscrew 42 (FIG. 2A). The secondary clamp 43 has a pin 81 (FIG. 2) protruding from each side of the secondary clamp 43. The protruding pins 81 pivotally engage into openings 81 in each of two actuator links 53.

The adjustment washer 45 includes rubber isolation pads 50 on its top face upon which the lower cymbal 15 rests. The bushing 36 of the secondary rod guide assembly 31 extends through the center of the adjustment washer 45 to isolate the vibrations of the cymbals 15 and 17, and to stabilize the position of the lower cymbal 15. The rubber isolation pads 50 are small to reduce the contact area between the isolation pads and the lower cymbal 17 to thereby reduce any potential muting effects on the lower cymbal 17.

It should be noted that the secondary actuator rod 41 does not extend past the top surface of the upper cymbal 17. This unique feature of the present invention substantially reduces the interferences that usually exists with other cymbals stands. These interferences exists because the actuator rod in those stands protrudes extensively above the upper surface of the upper cymbal. This protrusion results in interference between the striking ends of the drumsticks and the protruding actuator rod when the percussionist is playing the cymbals. The design of this embodiment of the present invention eliminates that interference by using a cap 47 on the top of the upper cymbal 17 that results in no protrusion at all of any part of the secondary actuator rod 41.

Adjustment of the Present Embodiment of the Invention

Figure 10:
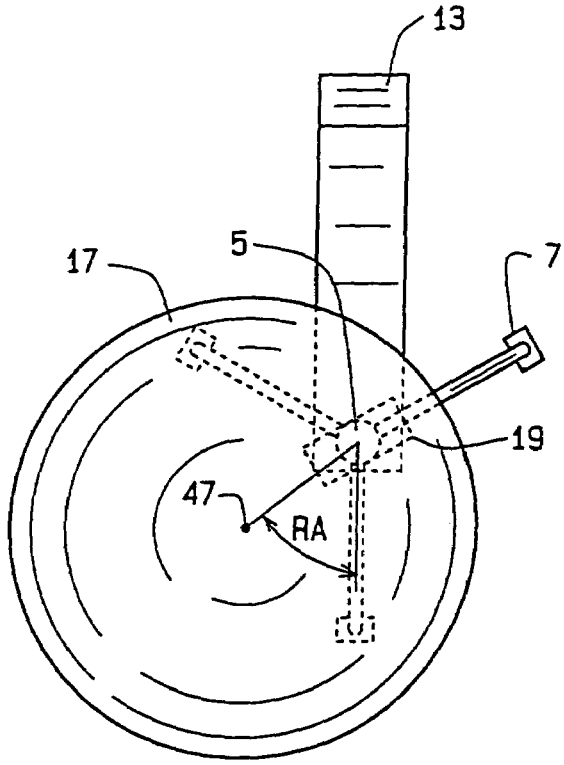
FIG. 10 is an overhead view of the adjustable cymbal device illustrating the ability to rotate one embodiment of the invention.

In the preferred embodiment of the present invention, the adjustable cymbal device A comprises a number of elements as described in the preceding paragraphs that operatively and mechanically connect the foot pedal 13 of the standard cymbal stand 5 to a set of hi-hat cymbals that include a lower cymbal 15 and an upper cymbal 17. In addition, these elements provide the ability to adjust a number of positional relationships between the cymbals and the performer including:

1) the length of upper cymbal travel ("UCT" as shown in FIG. 2);
2) the tilt ("T" as shown in FIG. 6) of the entire adjustable cymbal device A;
3) the offset ("OFS" as shown in FIG. 2) of the entire adjustable cymbal device A;
4) the rotational angle ("RA" as shown in FIG. 10) of the entire adjustable cymbal device 3; and
5) the tilt ("CT" as shown in FIG. 6) of the lower cymbal 15 relative to the upper cymbal 17.

These relationships will be described in further detail below. It is important to note that each of these positional relationships is adjustable to provide ergonomic benefits and accommodate the playing needs of the percussionist.

As shown in FIG. 10, the rectangular mounting block 19 can be attached to the standard cymbal stand 5 at any rotational angle RA relative to the foot pedal 13. This feature allows the performer to position the adjustable cymbal device A in a wide range of positions that will best suit the desired playing position or playing style of the percussionist.

The position of the primary clamp 27 (FIG. 2) is vertically adjustable along the primary actuator rod 25 to provide for adjustment of the length of travel UCT of the upper cymbal 17. The upper cymbal travel UCT is relative to the length of the travel FPT (FIG. 1) of the foot pedal 13. Therefore, the length of the UVT increases as the primary clamp 27 (FIG. 2) is adjusted upward along the primary rod 25. Oppositely, by adjusting the primary clamp 27 downwards along the primary rod 25, the length of the UCT decreases. In this way, the upper cymbal travel UCT may be adjusted by the percussionist to fit the specific needs of the playing style desired by the percussionist. It is also important to note that once the UCT has been adjusted and set by the percussionist, the offset OFS, the tilt T, and the rotational angle RA of the current embodiment of the present invention are not substantially affected. This ability to set the length of the upper cymbal travel UCT at all rotational angles, tilt, and offset positions greatly benefits the playing style of the percussionist and increases the range of cymbal effects available to the percussionist.

The two tilting links 29 (FIG. 2 and FIG. 6) act to provide control over the general tilt T of the current embodiment of the present invention. The offset OFS and the tilt T of the present embodiment of adjustable cymbal device A is determined by the angle the two tilting links 29 make with the longitudinal axis of the primary actuator rod 25 which is normally in general axial alignment with the support shaft 9 of the standard cymbal stand 5. For purposes of this embodiment, the "Offset" is defined as the horizontal distance between the longitudinal axis of the stand 5 and the center of the upper cymbal 17. The "Tilt" is defined as the angle between the longitudinal axis of the standard cymbal stand 5 and the longitudinal axis of the secondary actuator rod 41.

To adjust the Offset of the adjustable cymbal device A, the four nuts 33A and 33B are loosened and the two tilting links 29 are rotated clockwise or counterclockwise around axis A to adjust the tilt and Offset of the entire adjustable cymbal device A. As the secondary actuator rod guide assembly 31 is tilted during adjustment, extension link 39 pivots around nuts and bolts 33B attached to tabs 37. Adjusting the two tilting links 29 to a more horizontal position locates the secondary actuator rod 41 in a more vertical position and thus increases the Offset.

FIG. 2 shows the two tilting links adjusted in a way that allows for a greater Offset. It is noted that in this position, the secondary actuator rod 41 is generally parallel to the primary actuator rod 25. When adjusted in this manner, the upper cymbal 17 and the lower cymbal 15 are located further away from the percussionist than if the cymbals 15 and 17 were mounted directly to the standard cymbal stand 5. In contrast, adjusting the two tilting links 29 to a more vertical position locates the secondary actuator rod 41 in a more tilted position and thus decreases the Offset. FIG. 6 shows the two tilting links 29 adjusted in a way that allows for smaller Offset. It is noted that in this position, the secondary actuator rod 41 is no longer generally parallel to the primary rod 25, but is instead at an angle.

In the present embodiment, the two tilting links 29 provide a angular range of adjustment between the primary actuator rod 25 and the secondary actuator rod 41 of between about 0 degrees to about 45 degrees. Once the desired position is achieved, the four nuts 33A and 33B are tightened to secure the two tilting links 29 in the Offset position desired by the percussionist.

It will be readily appreciated that the effect of the two tilting plates 29 is to provide the percussionist with a simple method of adjusting the Offset OFS and the tilt T of the adjustable cymbal device A. This offers the percussionist a wide range of adjusting the cymbals that will allow the cymbals to be positioned in at a variety of different angles, offsets, and heights.

Figure 7:
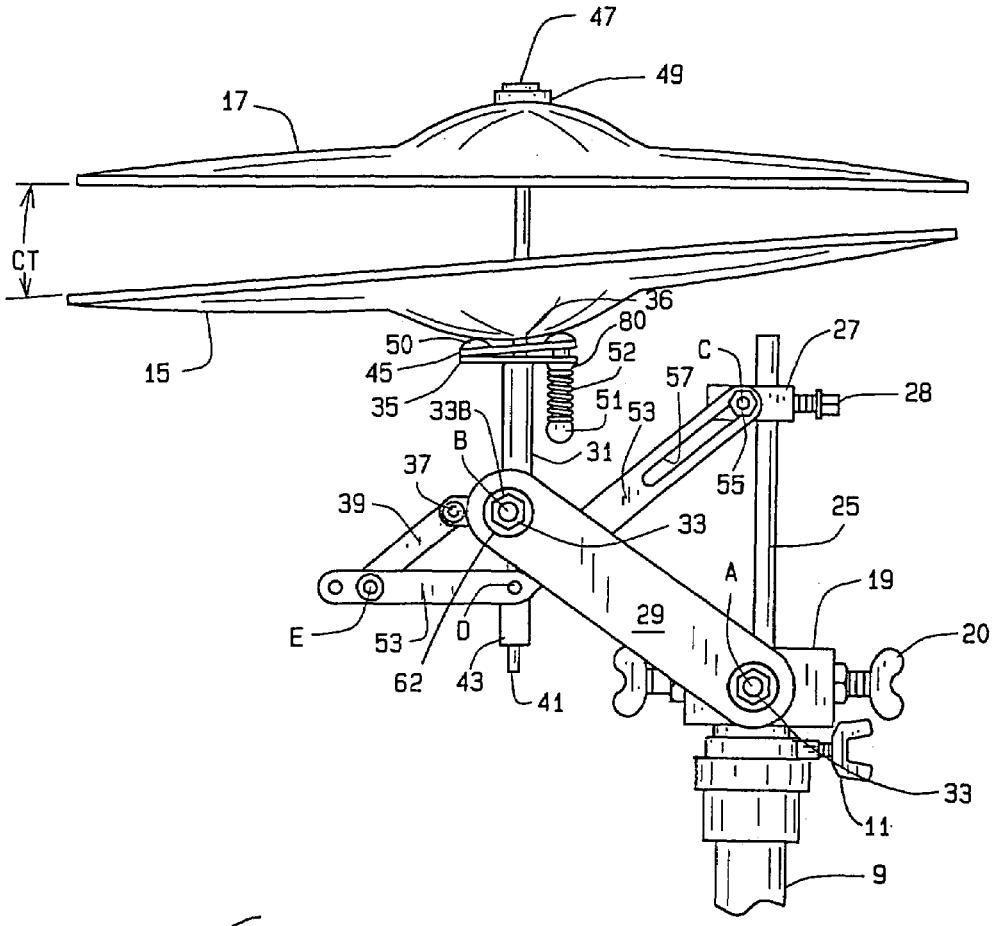
FIG. 7 is a side elevation view of the adjustable cymbal device illustrating the hi-hat cymbals in a nearly vertical position to show the adjustable tilt of a lower cymbal relative to an upper cymbal in one embodiment of the present invention.

While the positioning of the two tilting links 29 serves to adjust the Offset and the tilt of the adjustable cymbal device A, an additional tilt adjustment is also available to allow for the independent adjustment of the tilt of the secondary actuator rod 41 in relation to the primary actuator rod 25. This additional tilt adjustment is accomplished by first removing the two snap rings 71 (FIG. 7 & FIG. 2A) from the pin 73 that holds the extension link 39 in position between the two actuator links 53. The actuator links 53 have two openings 72 and 74 into which the pin 73 may be inserted. When the pin 73 is inserted into the openings 74, the position of the secondary actuator rod 41 is placed into a less vertical position. When the pin 73 is inserted into the opening 72, the position of the secondary actuator rod 41 is in a more vertical position. Thus, placement of the pin 73 in one of the openings 72 or 74 allows the percussionist to independently position the general tilt of the secondary actuator rod 41. Because the upper and lower cymbals, 17 and 15 respectively, are directly mounted onto the secondary actuator rod 41, changing the tilt of the secondary actuator rod 41 allows the percussionist to change the tilt of the upper and lower cymbals. When the percussionist has selected the desired tilt of the cymbals 15 and 17 by insertion of the pin 73 into one of the openings 72 or 74, the two snap rings 71 are reinstalled onto the pin 73 to retain the pin in the actuator links 53.

Because the secondary clamp 43 is a rectangular block that is secured to the secondary actuator rod 41 with a nut 42, such as a wing nut or square headed nut, the secondary actuator rod 41 is adjustable, thereby, providing for further adjustment of the upper cymbal travel UCT (FIG. 2). By adjusting the secondary actuator rod 41 upward, the upper cymbal travel UCT increases. Oppositely, by adjusting the secondary actuator rod 41 downward, the upper cymbal UCT decreases.

Operation of the Present Embodiment of the Invention

In operation, the percussionist presses his foot down on the foot pedal 13 (FIG. 1), which in turn lowers the primary actuator rod 25 and attached primary clamp 27. As the primary actuator rod 25 lowers, the primary clamp 27 pulls downwards on the two actuator links 53 at axis C. This pivots the actuator links 53 downward (clockwise in FIG. 7-8) about axis E. The downward rotation of the actuator links 53 pulls downward on the secondary clamp 43 that is attached to the secondary rod actuator 41 at axis D. As the secondary clamp 43 is pulled downward, the secondary actuator rod 41 is also pulled resulting in the downward motion of the upper cymbal 17 attached to the upper end of the secondary actuator rod 41. The downward movement of the upper cymbal 17 continues until the upper cymbal strikes the lower cymbal 15.

Figure 8:
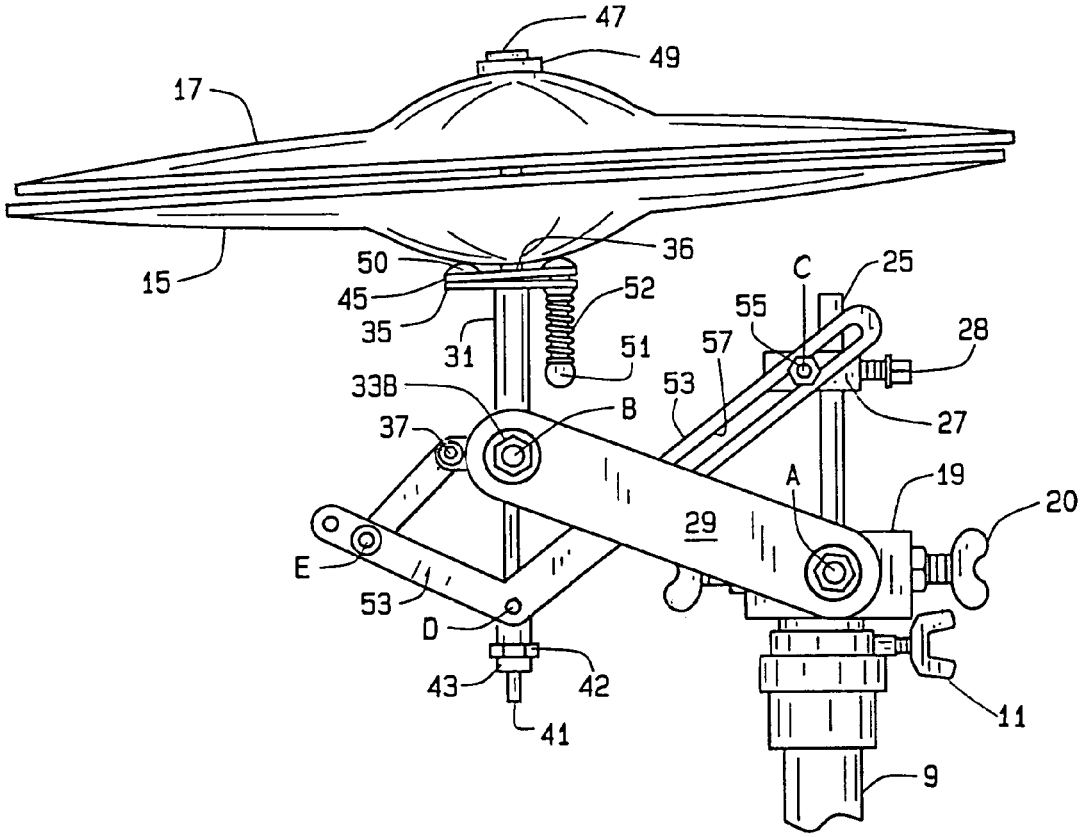
FIG. 8 is a side elevation view of the adjustable cymbal device with the cymbals in the closed position for one embodiment of the present invention.

It is appreciated that the sliding connection between the slots 57 of the actuator links 53 and the pins 55 allow the actuator links 53 to pivot along a radius about axis E while retaining a constant planar relationship between the primary actuator rod 25 and the secondary actuator rod 41 (FIG. 8).

When the percussionist lifts his foot up the motion reverses. The biasing element 10 moves the foot pedal 13 upward, which in turn raises the primary actuator rod 25 and the attached primary clamp 27. As the primary actuator rod 25 raises, the primary clamp 27 pushes upward on the actuator links 53 at axis C, thereby pivoting the actuator links 53 upwards (counterclockwise in FIGS. 7-8) about axis E. The upward rotation of the actuator links 53 pushes upward on the secondary actuator rod 41 at axis D to move the upper cymbal 17 upward and away from the lower cymbal 15. As before, the sliding connection between the slots 57 and the pins 55 allow the actuator links 53 to pivot along a radius about axis E while retaining a constant planar relationship between the primary actuator rod 25 and the secondary actuator rod 41.

While the above description describes various embodiments of the present invention, it will be clear that the present invention may be otherwise easily adapted to fit any configuration where an adjustable cymbal device is required. As various changes could be made in the above constructions without departing from the scope of the invention, it is intended that all matter contained in the above description or shown in the accompanying drawings shall be interpreted as illustrative and not in a limiting sense. For example, while certain types of fasteners are described herein for the embodiment shown, various other type of fasteners may be used and remain within the scope of the present invention as long as the fasteners selected perform the same or similar function as the fastener that is being replaced.

What is claimed is:

1. In combination with a standard hi-hat cymbal stand having a foot pedal, a primary actuator rod in communication with the foot pedal, and a primary support shaft having an extendable tube, the invention of an adjustable cymbal device comprising:

a secondary actuator rod;

an upper cymbal and a lower cymbal attached to the secondary actuator rod, an adjustment mechanism that communicates the movement of the primary actuator rod of the standard hi-hat cymbal stand to the secondary actuator rod of the adjustable cymbal device, the adjustment mechanism being capable of adjusting the length of travel of the upper cymbal travel in relation to the lower cymbal; of adjusting the offset of the secondary actuator rod in relation to the primary actuator rod; of adjusting the tilt of the upper cymbal in relation to the lower cymbal, and of adjusting the rotational angle of the adjustable cymbal device in relation to the standard hi-hat cymbal stand, and wherein the adjustment mechanism does not include at least one of either a cable, a chain, or other flexible element to communicate the movement of the primary actuator rod to the secondary actuator rod.

2. The combination of claim 1 further comprising a rectangular mounting block that allows the adjustable cymbal stand to be mounted to the extendable tube of the primary support shaft of the standard hi-hat cymbal stand.

3. The combination of claim 2 wherein the rectangular mounting block is substantially in the form of a rectangular box having a rectangular opening on its bottom that receives the extendable tube.

4. The combination of claim 3 wherein the extendable tube is secured within the rectangular opening of the rectangular mounting block by two fasteners, each fastener having a threaded rod with a wing nut and a V-shaped clamp pivotally attached to an end of the threaded rod.

5. The combination of claim 4 further comprising a bushing deposed on the rectangular mounting block, the bushing being sized to allow the primary shaft of the standard hi-hat stand to slideably reciprocate through the bushing when the foot pedal of the standard hi-hat stand is operated.

6. The combination of claim 5 wherein the bushing has an internal diameter of about between about 0.28 inch and about 0.29 inch.

7. The combination of claim 6 wherein the rectangular mounting block has at least one protruding threaded mounting rod.

8. The combination of claim 7 further comprising a primary clamp attached to the primary actuator rod of the standard hi-hat stand.

9. The combination of claim 8 further comprising at least one tilting link wherein one end of the at least one tilting link is attached to the at least one threaded mounting rod of the rectangular mounting block at an axis A, and the other end of the at least one tilting link is attached to a secondary rod guide assembly at an axis B.

10. The combination of claim 9 wherein the secondary rod guide assembly comprises a vertical tube, two circular flanges, two tabs, two friction washers, a bushing, an upper flange, and the at least one threaded rod protruding from each of the two circular flanges, wherein the two tabs are attached to the vertical tube near one end of the vertical tube and at about a 90 degree angle with the vertical tube such that the two tabs are generally parallel with each other, and wherein the two circular flanges are positioned in general alignment with the two tabs such that the flat surfaces of the two circular flanges are generally parallel with the flat surfaces of the two tabs.

11. The combination of claim 10 wherein each tab of the secondary rod guide assembly has a spacer positioned between each circular flange and its related tab.

12. The combination of claim 11 wherein a threaded rod protrudes from the center of each of the two circular flanges, wherein the two threaded rods are in axial alignment.

13. The combination of claim 12 wherein the bushing is sized to allow the bushing to be inserted into the vertical tube while still allowing the secondary rod to slide within the bushing.

14. The combination of claim 13 wherein the bushing is made from nylon and has an inside diameter of about 0.28 inch and an outside diameter of about 0.38 inch.

15. The combination of claim 14 further comprising an adjustment screw threaded through the upper flange of the secondary rod guide assembly to adjust an adjustment washer resting upon the secondary rod guide assembly.

16. The combination of claim 15 further comprising a nut attached to an underside of the upper flange to receive the adjustment screw and allow for the threaded adjustment of the adjustment screw.

17. The combination of claim 16 further comprising a compression spring used in combination with the adjustment screw to prevent the adjustment screw from backing out the nut as a result of the vibration of the upper cymbal and the lower cymbal when struck by a percussionist.

18. The combination of claim 17 wherein the adjustment washer includes rubber isolation pads on its top face upon which the lower cymbal can rest.

19. The combination of claim 18 further comprising at least one actuator link slideably attached to a nut and bolt of the primary clamp 27 at axis C.

20. The combination of claim 19 wherein the at least one actuator link is attached to a secondary clamp at an axis D, and to an extension link at axis E, the extension link also being attached to the tabs of the secondary rod guide assembly.

21. The combination of claim 20 wherein the at least one actuator link is an obtusely angled plate set at a predetermined obtuse angle, wherein the actuator link has an opening that is located near the apex of the obtuse angle, wherein one end of each of the actuator link has a slot that allows the actuator link to reciprocate around the bolt and nut of the primary clamp, and wherein the other end of the actuator link has two pivot openings aligned long the longitudinal axis of the actuator link and spaced a distance apart.

22. The combination of claim 21 wherein the secondary clamp as a pin protruding from each side of the secondary clamp such that the pivotally engages into one of the two pivot openings in the at least one actuator link.

23. The combination of claim 22 wherein one end of the extension link is attached to the at least one actuator link with a pin and snap rings, and the other end of the extension link is attached to the two tabs of the secondary rod guide assembly with a pin and snap rings.

24. The combination of claim 23 wherein the at least one actuator link communicates the movement of the primary actuator rod of the standard hi-hat cymbal stand to the secondary actuator rod to move the upper cymbal toward or away from the lower cymbal.

25. The combination of claim 24 wherein the secondary actuator rod has a cap on one end, and includes a threaded portion that extends from cap such that the upper cymbal is attached to the secondary actuator rod by installing a first felt pad the cap and the upper cymbal, installing a second felt pad and a second cap beneath the upper cymbal, and installing a first nut installed onto the threaded portion of the secondary actuator rod.

26. The combination of claim 25 further comprising a second nut installed onto the threaded portion of the secondary actuator rod such that the second nut acts as a jamb nut to inhibit the first nut from being loosened by the vibration of the upper cymbal and the lower cymbal the cymbals are played by the percussionist.

27. In combination with a standard hi-hat cymbal stand having a foot pedal, a primary actuator rod in communication with the foot pedal, and a primary support shaft having an extendable tube, the invention of an adjustable cymbal device comprising means for communicating movement of the primary actuator rod of the standard hi-hat cymbal stand to a secondary actuator rod upon which an upper cymbal and a lower cymbal are mounted, wherein the means for communicating movement between the primary actuator rod and the secondary actuator rod does not include at least one of either a cable, a chain, or other flexible element to communicate such movement, wherein said means for communicating movement is capable of adjusting the length of travel of the upper cymbal travel in relation to the lower cymbal, and wherein said means for communicating movement is capable of adjusting the offset of the secondary actuator rod in relation to the primary actuator rod.

28. The combination of claim 27 wherein said means for communicating movement is capable of adjusting the tilt of the upper cymbal in relation to the lower cymbal.

29. The combination of claim 28 wherein said means for communicating movement is capable of adjusting the rotational angle of the adjustable cymbal device in relation to the standard hi-hat cymbal stand.

30. The combination of claim 29 wherein said means for communicating movement communicates the movement of the primary actuator rod to the secondary actuator rod when a percussionist depresses the foot pedal of the standard hi-hat cymbal stand, which in turn lowers the primary actuator rod and the attached primary clamp such that as the primary rod lowers, the primary clamp pulls downwards on two actuator links at an axis C which pivots the actuator links downward about axis F, wherein the downward rotation of the two actuator links pulls downward on the secondary clamp that is attached to the secondary rod actuator at axis D such that the secondary clamp is pulled downward to thereby pull the secondary actuator rod and the upper cymbal in a downward motion until the upper cymbal strikes the lower cymbal.

31. The combination of claim 30 wherein a sliding connection between a slot in the actuator links and the pins on the primary clamp allow the actuator links to pivot along a radius about axis F while retaining a constant planar relationship between the primary actuator rod and the secondary actuator rod.

32. In combination with a standard hi-hat cymbal stand having a foot pedal, a primary actuator rod in communication with the foot pedal, and a primary support shaft having an extendable tube, the invention of an adjustable cymbal device comprising:

a secondary actuator rod;

an upper cymbal and a lower cymbal attached to the secondary actuator rod, a rectangular mounting block that allows the adjustable cymbal stand to be mounted to an extendable tube of a primary support shaft of a standard hi-hat cymbal stand, wherein the rectangular mounting block is substantially In the form of a rectangular box having a rectangular opening on its bottom that receives the extendable tube, and wherein the extendable tube is secured within the rectangular opening of the rectangular mounting block by two fasteners, each fastener having a threaded rod with a wing nut and a V-shaped amp pivotally attached to an end of the treaded rod; and an adjustment mechanism that communicates the movement of the primary actuator rod of the standard hi-hat cymbal and to the secondary actuator rod of the adjustable cymbal device, the adjustment mechanism being capable of adjusting the length of travel of the upper cymbal travel In relation to the lower cymbal; of adjusting the offset of the secondary actuator rod In relation to the primary actuator rod; and of adjusting the tilt of the upper cymbal in relation to the lower cymbal, and of adjusting the rotational angle of the adjustable cymbal device in relation to the standard hi-hat cymbal and.

33. In combination with a standard hi-hat cymbal and having a foot pedal, a primary actuator rod In communication with the foot pedal, and a primary support shaft having an extendable tube, the Invention of an adjustable cymbal device comprising:

means for communicating movement of the primary actuator rod of the standard hi-hat cymbal stand to a secondary actuator rod upon which an upper cymbal and a lower cymbal are mounted;

wherein said means for communicating movement is capable of adjusting the length of travel of the upper cymbal travel in relation to the lower cymbal;

wherein said means for communicating movement is capable of adjusting the offset of the secondary actuator rod in relation to the primary actuator rod;

wherein said means for communicating movement is capable of adjusting the tilt of the upper cymbal in relation to the lower cymbal;

wherein said means for communicating movement is capable of adjusting the rotational angle of the adjustable cymbal device in relation to the standard hi-hat cymbal stand; and wherein said means for communicating movement communicates the movement of the primary actuator rod to the secondary actuator rod when a percussionist depresses the foot pedal of the standard hi-hat cymbal stand, which in turn lowers the primary actuator rod and the attached primary clamp such that as the primary rod lowers, the primary clamp pulls downwards on two actuator links at an axis C which pivots the actuator links downward about axis E such that the downward rotation of the two actuator links pulls downward on the secondary clamp that is attached to the secondary rod actuator at axis D so that the secondary clamp is pulled downward to thereby pull the secondary actuator rod and the upper cymbal in a downward motion until the upper cymbal strikes the lower cymbal.

* * * * *